US012270580B2

(12) United States Patent
Ryu et al.

(10) Patent No.: US 12,270,580 B2
(45) Date of Patent: Apr. 8, 2025

(54) HEAT PUMP AND CONTROL METHOD THEREFOR

(71) Applicant: LG ELECTRONICS INC., Seoul (KR)

(72) Inventors: Jihyeong Ryu, Seoul (KR); Eunjun Cho, Seoul (KR); Minsoo Kim, Seoul (KR); Youngmin Lee, Seoul (KR); Hojin Seo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 185 days.

(21) Appl. No.: 18/015,569

(22) PCT Filed: Jul. 12, 2021

(86) PCT No.: PCT/KR2021/008879
§ 371 (c)(1),
(2) Date: Jan. 11, 2023

(87) PCT Pub. No.: WO2022/014984
PCT Pub. Date: Jan. 20, 2022

(65) Prior Publication Data

US 2023/0288105 A1 Sep. 14, 2023

(30) Foreign Application Priority Data

Jul. 14, 2020 (KR) ..... 10-2020-0086867

(51) Int. Cl.
*F25B 25/00* (2006.01)
*F24D 3/10* (2006.01)
(Continued)

(52) U.S. Cl.
CPC ..... *F25B 25/005* (2013.01); *F24D 3/1008* (2013.01); *F24D 3/18* (2013.01);
(Continued)

(58) Field of Classification Search
CPC .... F25B 25/005; F25B 19/02; F25B 2500/24; F25B 2700/19; F25B 2500/15; F25B 2700/1931; F24D 3/1008; F24D 3/18
See application file for complete search history.

(56) References Cited

U.S. PATENT DOCUMENTS 5,746,062 A * 5/1998 Beaverson ..... F25B 1/053 62/228.3
2011/0072840 A1 3/2011 Itagaki et al.

FOREIGN PATENT DOCUMENTS

JP 05-288438 11/1993
JP 11-257768 9/1999
(Continued)

OTHER PUBLICATIONS

English language translation of JP6498411 to Nikaido et al. Translated Sep. 2024 (Year: 2014).*
(Continued)

*Primary Examiner* — Cassey D Bauer
(74) *Attorney, Agent, or Firm* — KED & ASSOCIATES

(57) ABSTRACT

A heat pump and a control method thereof are provided. The heat pump includes an outdoor unit includes a compressor that compresses a first refrigerant, a first outdoor heat exchanger that exchanges heat between the first refrigerant and outdoor air, an expansion mechanism that expands the first refrigerant, and a second outdoor heat exchanger that exchanges heat between the first refrigerant and a second refrigerant; a first refrigerant pipe that connects the compressor, the first outdoor heat exchanger, and the expansion mechanism, and through which the first refrigerant flows; a pressure sensor disposed in the first refrigerant pipe; a second refrigerant pipe connected to the second outdoor heat exchanger, and through which the second refrigerant flows; an indoor heat exchanger that is disposed in the second refrigerant pipe, and exchanges heat between indoor air and
(Continued)

the second refrigerant; and a controller that determines a supply of the second refrigerant by determining a flow rate of the second refrigerant based on surging occurring in a pressure of the first refrigerant measured by the pressure sensor, so that the flow rate of the second refrigerant flowing through the second refrigerant pipe is determined only by the pressure value of the first refrigerant measured by the pressure sensor disposed in the first pipe, thereby determining the flow rate of the second refrigerant without a separate flow sensor.

17 Claims, 4 Drawing Sheets

(51) Int. Cl.
*F24D 3/18* (2006.01)
*F25B 49/02* (2006.01)

(52) U.S. Cl.
CPC ..... *F25B 49/02* (2013.01); *F25B 2500/24* (2013.01); *F25B 2700/19* (2013.01)

(56) References Cited

FOREIGN PATENT DOCUMENTS

| | | | |
|---|---|---|---|
| JP | 2005-055167 | | 3/2005 |
| JP | 2011-241760 | | 12/2011 |
| JP | 5543175 | B2 * | 7/2014 |
| JP | 6498411 | B2 * | 4/2019 |
| KR | 10-2015-0009201 | | 1/2015 |

OTHER PUBLICATIONS

English language translation of JP5543175 to Chokki (Year: 2014).*
International Search Report dated Nov. 11, 2021 issued in Application No. PCT/KR2021/008879.
European Search Report issued in Application No. 21843162.5 dated Jul. 17, 2024.

* cited by examiner

HEAT PUMP AND CONTROL METHOD THEREFOR

CROSS-REFERENCE TO RELATED PATENT APPLICATIONS

This application is a U.S. National Stage Application under 35 U.S.C. § 371 of PCT Application No. PCT/KR2021/008879, filed Jul. 12, 2021, which claims priority to Korean Patent Application No. 10-2020-0086867, filed Jul. 14, 2020, whose entire disclosures are hereby incorporated by reference.

TECHNICAL FIELD

The present disclosure relates to a heat pump and a control method thereof, and more particularly, to a heat pump for determining a refrigerant shortage and supplying insufficient refrigerant, and a control method thereof.

BACKGROUND ART

A heat pump is an apparatus that transfers heat from a low temperature object to a high-temperature object. A heat pump is an apparatus that cools or heats a room by using a refrigeration cycle including a compressor, an outdoor heat exchanger, an expansion device, and an indoor heat exchanger. The heat pump may have two assemblies of an outdoor unit and an indoor unit. Among them, the outdoor unit is installed outside, and includes a compressor and an outdoor heat exchanger. The indoor unit is installed indoors, and includes an indoor heat exchanger.

AWHP is one of conventional heat pump technologies. AWHP stands for Air to Water Heat Pump. The heat pump constitutes a first refrigerant cycle for heating a first refrigerant by using air as a heat source. The first refrigerant is generally a gas refrigerant. The first refrigerant has a heat exchanger that exchanges heat with a second refrigerant. The second refrigerant constitutes a second refrigerant cycle separate from the first refrigerant. The second refrigerant is generally water. The second refrigerant cycle includes an indoor heat exchanger that exchanges heat with indoor air, and cools and heats indoor air.

However, in the related art, water as the second refrigerant evaporates over time, and bubbles are generated in a pipe. When bubbles are generated, there is a problem in that circulation of the refrigerant occurs, and heating capacity is reduced or cooling and heating efficiency is reduced.

In order to solve the above problems of the related art, the related art is provided with a flow sensor. However, the flow sensor is generally disposed in the first refrigerant cycle, and is not disposed in the second refrigerant cycle apart from being able to determine the flow rate of the first refrigerant. Therefore, when the flow sensor according to the related art detects an error, there is a problem in that it is difficult to distinguish whether the first refrigerant is insufficient or the second refrigerant is insufficient.

DISCLOSURE

Technical Problem

An object of the present disclosure provides a heat pump for determining the flow rate of a second refrigerant, even when there is no flow sensor, and a control method thereof.

Another object of the present disclosure further provides a heat pump for rapidly determining the flow rate of a second refrigerant and easily supplying the second refrigerant, and a control method thereof.

The objects of the present disclosure are not limited to the objects mentioned above, and other objects not mentioned will be clearly understood by those skilled in the art from the following description.

Technical Solution

In order to achieve the above object, according to an embodiment of the present disclosure, there is provided a heat pump including an outdoor unit including a compressor for compressing a first refrigerant, a first outdoor heat exchanger for exchanging heat between the first refrigerant and outdoor air, an expansion mechanism for expanding the first refrigerant, and a second outdoor heat exchanger for exchanging heat between the first refrigerant and a second refrigerant; a first refrigerant pipe which connects the compressor, the first outdoor heat exchanger, and the expansion mechanism, and through which the first refrigerant flows; a pressure sensor disposed in the first refrigerant pipe; a second refrigerant pipe which is connected to the second outdoor heat exchanger, and through which the second refrigerant flows; an indoor heat exchanger which is disposed in the second refrigerant pipe, and exchanges heat between indoor air and the second refrigerant; and a controller configured to determine a supply of the second refrigerant by determining a flow rate of the second refrigerant based on surging occurred in a pressure of the first refrigerant measured by the pressure sensor.

The pressure sensor is disposed in the first refrigerant pipe adjacent to a discharge port of the compressor.

The controller supplies the second refrigerant, when surging is repeated a preset number of times or more for a preset time, after an initial surging occurs.

The heat pump further includes a compressor injection pipe connected to the compressor and a compressor injection valve disposed in the compressor injection pipe, wherein the controller supplies the second refrigerant when the compressor injection valve is not opened.

The controller supplies the second refrigerant, when a difference between a current number of revolutions of the compressor and a number of revolutions at the time of initial surging is equal to or less than a preset number of revolutions.

The heat pump further includes a second refrigerant pipe port disposed in the second refrigerant pipe, wherein the controller supplies the second refrigerant through the second refrigerant pipe port, when it is determined that a flow rate of the second refrigerant is insufficient.

The heat further includes: a boiler which is disposed in parallel with the outdoor unit, and heats a second refrigerant; and a third refrigerant pipe which connects the boiler and the indoor heat exchanger, and through which the second refrigerant flows, wherein the controller operates the boiler and supplies the second refrigerant to the indoor heat exchanger, when it is determined that the flow rate of the second refrigerant is insufficient.

The heat pump further includes: an indoor heat exchanger switching valve which is connected to the indoor heat exchanger or at least one of the second refrigerant pipe and the third refrigerant pipe, and switches a refrigerant flow between the indoor heat exchanger and the second refrigerant pipe and the third refrigerant pipe, wherein the controller opens the indoor heat exchanger switching valve so that the indoor heat exchanger and the third refrigerant pipe communicate with each other, when it is determined that the flow rate of the second refrigerant is insufficient.

The boiler comprises: an expansion tank disposed in the third refrigerant pipe; and a boiler pump which is disposed in the third refrigerant pipe, and pumps the third refrigerant.

The heat pump further includes an indoor unit through which the second refrigerant pipe passes, and which comprises an indoor unit pump that is disposed in the second refrigerant pipe and pumps the second refrigerant.

In order to achieve the above object, according to an embodiment of the present disclosure, there is provided a method of controlling a heat pump including an outdoor unit including a compressor for compressing a first refrigerant, a first outdoor heat exchanger for exchanging heat between the first refrigerant and outdoor air, an expansion mechanism for expanding the first refrigerant, and a second outdoor heat exchanger for exchanging heat between the first refrigerant and a second refrigerant; a second refrigerant pipe which is connected to the second outdoor heat exchanger, and through which the second refrigerant flows; and an indoor heat exchanger which is disposed in the second refrigerant pipe, the method including: operating the outdoor unit; detecting a surging of a pressure of the first refrigerant, by a pressure sensor disposed in a first refrigerant pipe connecting the compressor, the first outdoor heat exchanger, and the expansion mechanism; operating the outdoor unit until a preset time elapses; and supplying the second refrigerant, when a surging of the pressure is detected a preset number of times or more during the preset time.

Advantageous Effects

According to the heat pump of the present disclosure and the control method thereof, one or more of the following effects are provided.

First, since a pressure sensor is disposed in a first refrigerant pipe, and the flow rate of a second refrigerant flowing through a second refrigerant pipe is determined only by a measured value of the pressure sensor, there is an advantage of being able to determine the flow rate of the second refrigerant without a separate flow rate sensor.

Second, since the flow rate of the second refrigerant is determined without a separate flow rate sensor and quickly supplying the second refrigerant, there is also an advantage of securing the heating and cooling capacity of the heat pump.

The effects of the present disclosure are not limited to the effects mentioned above, and other effects not mentioned will be clearly understood by those skilled in the art from the description of the claims.

MODE FOR INVENTION

Figure 1:
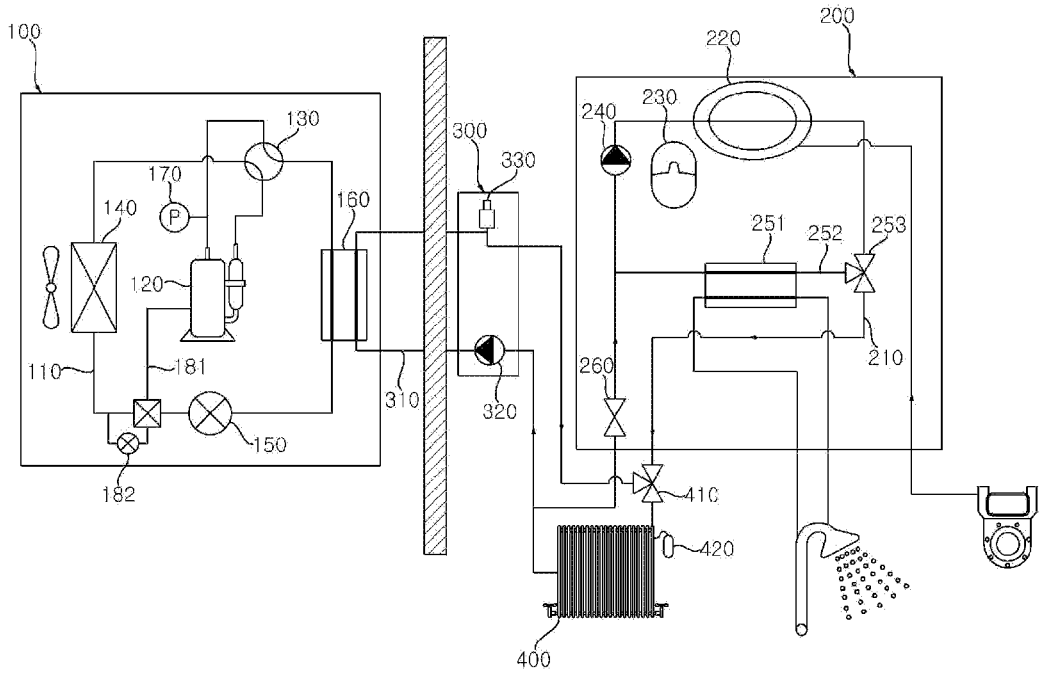
FIG. 1 is a schematic structural diagram of a heat pump according to the present disclosure.

Advantages and features of the present disclosure and methods of achieving them will become apparent with reference to the embodiments described below in detail in conjunction with the accompanying drawings. However, the present disclosure is not limited to the embodiments disclosed below, but may be implemented in various different forms, and these embodiments are provided only to allow the disclosure of the present disclosure to be complete, and to completely inform those of ordinary skill in the art to which the present disclosure belongs, the scope of the invention, and the present disclosure is only defined by the scope of the claims. Like reference numerals refer to like elements throughout.

Hereinafter, the present disclosure will be described with reference to drawings for explaining a heat pump and a control method thereof according to embodiments of the present disclosure.

A heat pump according to the present disclosure includes an outdoor unit 100, an indoor heat exchanger 400, an indoor unit 300, and a boiler 200.

In the outdoor unit 100, a first refrigerant circulates. A second refrigerant pipe 310 connects the outdoor unit 100 and the indoor heat exchanger 400. A second refrigerant flows in the second refrigerant pipe 310. In the second outdoor heat exchanger 160 of the outdoor unit 100, heat exchange occurs between the first refrigerant and the second refrigerant. The second refrigerant pipe 310 guides the heat-exchanged second refrigerant to the indoor heat exchanger 400.

The first refrigerant may be a gas refrigerant. The second refrigerant may be water.

The indoor heat exchanger 400 is disposed indoors, and exchanges heat with indoor air. The second refrigerant pipe 310 is connected to the indoor heat exchanger 400, and the second refrigerant flows therethrough. The indoor heat exchanger 400 receives the second refrigerant heat-exchanged in the outdoor unit 100, and heat-exchanges the second refrigerant with the indoor air.

When the second refrigerant, which is water, is insufficient, the following problems occur. As the second refrigerant evaporates over time, bubbles are generated in a pipe. When bubbles are generated, the flow of the second refrigerant is not smooth, and cooling and heating performance is deteriorated. Therefore, it is necessary to measure the flow rate of the second refrigerant and fill an insufficient amount.

However, the flow sensor is generally disposed in a first refrigerant pipe 110 of the outdoor unit 100. Therefore, if an error occurs in a measured value measured by the flow sensor, there is a problem in that it cannot be clearly distinguished whether the phenomenon is caused by a shortage of the first refrigerant pipe 110 or a shortage of the second refrigerant pipe 310. Therefore, a measurement method for accurately measuring the flow rate of the second refrigerant is required.

Therefore, the heat pump according to the present disclosure suggests a control method of accurately measuring the flow rate of the second refrigerant based on the measured value of a pressure sensor 170 disposed in the first refrigerant pipe 110, and additionally supplying the second refrigerant. According to the present disclosure, the pressure sensor 170 measures the pressure of the first refrigerant and transmits it to the controller 500. The controller 500 receives data on the pressure of the first refrigerant, detects surging of the first refrigerant, and determines insufficient flow rate of the second refrigerant.

The outdoor unit 100 includes a compressor 120 that compresses a first refrigerant, a first outdoor heat exchanger 140 that exchanges heat between the outdoor air and the first refrigerant, an expansion mechanism 150 that expands the first refrigerant, and a second outdoor heat exchanger 160 that exchanges heat between the first refrigerant and the second refrigerant.

Hereinafter, with reference to FIG. 1, main components constituting the outdoor unit 100 will be described based on heating operation.

The compressor 120 compresses the inflowing low temperature-low pressure first refrigerant into high temperature-high pressure first refrigerant. The compressor 120 may have various structures, and may be a reciprocating compressor using a cylinder and a piston or a scroll compressor using an orbiting scroll and a fixed scroll. The compressor 120 in this embodiment is a scroll compressor. Although one compressor 120 is shown in the present disclosure, a plurality of compressors 120 may be provided according to embodiments.

The compressor 120 guides the high temperature-high pressure refrigerant to an outdoor unit switching valve 130.

The outdoor unit switching valve 130 is a device which is connected to a plurality of pipes and switches the refrigerant flow path. Referring to FIG. 1, the outdoor unit switching valve 130 is connected to the compressor 120, the first outdoor heat exchanger 140, and the second outdoor heat exchanger 160. As the outdoor unit switching valve 130 is switched, a switching between a cooling operation and a heating operation may be achieved.

FIG. 1 shows the outdoor unit switching valve 130 during heating operation. During heating operation, the outdoor unit switching valve 130 connects an outlet end of the compressor 120 and the second outdoor heat exchanger 160, and connects an inlet end of the compressor 120 and the first outdoor heat exchanger 140.

Although not shown, during cooling operation, the outdoor unit switching valve 130 connects the outlet end of the compressor 120 and the first outdoor heat exchanger 140, and connects the inlet end of the compressor 120 and the second outdoor heat exchanger 160.

The second outdoor heat exchanger 160 heat-exchanges between the second refrigerant and the high temperature-high pressure first refrigerant supplied from the compressor 120, based on the heating operation. One side of the second outdoor heat exchanger 160 is connected to the first refrigerant pipe 110, and the first refrigerant flows therethrough. The other side of the second outdoor heat exchanger 160 is connected to the second refrigerant pipe 310, and the second refrigerant flows therethrough. The first refrigerant and the second refrigerant do not exchange material, but exchange heat with each other.

During the heating operation, the second outdoor heat exchanger 160 serves as a condenser that cools and condenses the refrigerant. The second outdoor heat exchanger 160 cools the high temperature-high pressure first refrigerant and discharges it as a low temperature-high pressure refrigerant. The low temperature-high pressure refrigerant discharged from the outdoor heat exchanger flows into the expansion mechanism 150.

The expansion mechanism 150 is a device that expands the first refrigerant and discharges the low temperature-low pressure first refrigerant. Since the expansion mechanism 150 is fully opened to pass the refrigerant during heating operation, the low temperature-high pressure first refrigerant discharged from the second outdoor heat exchanger 160 is discharged in an extremely low temperature-low pressure state. The low temperature-low pressure first refrigerant discharged from the expansion mechanism 150 flows into the first outdoor heat exchanger 140.

The first outdoor heat exchanger 140 is a device that exchanges heat between the low temperature-low pressure first refrigerant and the outdoor air. The first outdoor heat exchanger 140 serves as an evaporator for evaporating the refrigerant during heating operation. The refrigerant discharged from the first outdoor heat exchanger 140 flows into the compressor 120 again.

The outdoor unit 100 includes a pressure sensor 170. The pressure sensor 170 is a component that measures the pressure of the refrigerant.

The pressure sensor 170 is disposed in the first refrigerant pipe 110. More specifically, the pressure sensor 170 is disposed in the first refrigerant pipe 110 adjacent to the outlet end of the compressor 120. Accordingly, the pressure sensor 170 may measure the pressure of the first refrigerant discharged from the compressor 120.

The pressure sensor 170 transmits the measured pressure value of the first refrigerant to the controller 500.

The heat pump includes the indoor heat exchanger 400. The indoor heat exchanger 400 is a component that exchanges heat between the indoor air and the second refrigerant. The indoor heat exchanger 400 is connected to the second refrigerant pipe 310, and circulates the second refrigerant. In the indoor heat exchanger 400, the second refrigerant heat-exchanged in the second outdoor heat exchanger 160 is introduced, the second refrigerant exchanges heat with indoor air, and the heat-exchanged second refrigerant is discharged.

A temperature sensor may be disposed in the indoor heat exchanger 400. The temperature sensor measures the temperature of the indoor heat exchanger 400 or the temperature of the second refrigerant and transmits it to the controller 500. The controller 500 compares the measured value of the temperature sensor with the target temperature and controls the heat pump.

An indoor heat exchanger switching valve 410 may be disposed in the indoor heat exchanger 400. The indoor heat exchanger switching valve 410 is disposed in the inlet side of the indoor heat exchanger 400. The indoor heat exchanger switching valve 410 is connected to the indoor heat exchanger 400, the second refrigerant pipe 310, and a third refrigerant pipe 210. The indoor heat exchanger switching valve 410 may be a three-way valve.

For example, when a port in the second refrigerant pipe 310 side and a port in the indoor heat exchanger 400 side are open, the second refrigerant flows through the outdoor unit 100 and the indoor heat exchanger 400, and air conditioning is performed by the outdoor unit 100. Unlike this, when a port in the third refrigerant pipe 210 side and a port in the indoor heat exchanger 400 side are open, the second refrigerant flows through the boiler 200 and the indoor heat exchanger 400, and is air-conditioned by the boiler 200.

The heat pump may include the indoor unit 300. The indoor unit 300 is a component that is disposed between the outdoor unit 100 and the indoor heat exchanger 400 and allows the second refrigerant to flow. The indoor unit 300 may be disposed indoors, but may not be disposed in a space where a user lives.

A second refrigerant pipe 310 is connected to the indoor unit 300. Referring to FIG. 1, the second refrigerant discharged from the second outdoor heat exchanger 160 passes through the indoor unit 300 and flows into the indoor heat exchanger 400. Similarly, the second refrigerant discharged from the indoor heat exchanger 400 passes through the indoor unit 300 and flows into the second outdoor heat exchanger 160.

The indoor unit 300 includes an indoor unit pump 320. The indoor unit pump 320 is a component that flows the second refrigerant. The indoor unit pump 320 is disposed in the second refrigerant pipe 310. The indoor unit pump 320 is disposed in the second refrigerant pipe 310 between the outlet end of the indoor heat exchanger 400 and the inlet end of the second outdoor heat exchanger 160. The indoor unit pump 320 pressurizes the second refrigerant to generate flow.

The indoor unit 300 includes a second refrigerant pipe port 330. The second refrigerant pipe port is a component that selectively connects the second refrigerant pipe 310 with other components. The second refrigerant pipe port 330 is disposed in the second refrigerant pipe 310 between the outlet end of the second outdoor heat exchanger 160 and the inlet end of the indoor heat exchanger 400. A second refrigerant supply port is formed in the second refrigerant pipe port 330 to supply the second refrigerant.

The boiler 200 is a component that heats a room by heating the second refrigerant. The boiler 200 is disposed in parallel with the outdoor unit 100. Accordingly, the indoor heat exchanger 400 may receive heat from the outdoor unit 100 or may receive heat from the boiler 200.

The boiler 200 includes a third refrigerant pipe 210. The third refrigerant pipe 210 connects each component of the boiler 200, and the second refrigerant flows therein. The third refrigerant pipe 210 connects the boiler 200 and the indoor heat exchanger 400 to circulate the second refrigerant between the boiler 200 and the indoor heat exchanger 400.

The third refrigerant pipe 210 is disposed in parallel with the second refrigerant pipe 310. Accordingly, the second refrigerant may flow through the second refrigerant pipe 310, or flow through the third refrigerant pipe 210.

When a boiler shut-off valve 260 is opened, the second refrigerant flows in the third refrigerant pipe. A flow of the second refrigerant is generated by a boiler pump 240. The second refrigerant is heated by a burner 220 and absorbs heat. The second refrigerant may pass through a hot water heat exchanger 251 to provide hot water.

The boiler 200 includes the burner 220. The burner 220 heats the second refrigerant. The burner 220 may be operated by gas or oil.

The boiler 200 includes an expansion tank 230. The expansion tank 230 is a component that buffers the volume change of water. The volume of the second refrigerant, which is water, expands or contracts according to the temperature change, and the second refrigerant flows to the expansion valve by the volume change amount. For example, when the second refrigerant is heated to expand its volume, a part of the second refrigerant flows into the expansion tank 230 and is stored therein. Similarly, when the second refrigerant is cooled to reduce its volume, a part of the second refrigerant is discharged from the expansion tank 230.

The expansion tank 230 may be disposed upstream of the burner 220. The expansion tank 230 may be disposed upstream of boiler pump 240. When disposed downstream of the burner 220, the second refrigerant that absorbed heat flows into the expansion tank 230 and a thermal energy can be dissipated. Therefore, it is preferable that the expansion tank 230 is disposed upstream of the burner 220 for energy efficiency.

The boiler 200 includes the boiler pump 240. The boiler pump 240 is a component for flowing the second refrigerant existing in the third refrigerant pipe 210.

The boiler pump 240 may be disposed upstream of the burner 220. Since the second refrigerant flowing in downstream of the burner 220 is high temperature, the boiler pump 240 may be damaged. Therefore, the boiler pump 240 is disposed upstream of the burner 220.

The boiler 200 includes the hot water heat exchanger 251. The hot water heat exchanger 25 is a component that heats hot water for supply, when supplying hot water. The hot water heat exchanger 25 exchanges heat between the second refrigerant and hot water for supply.

The hot water heat exchanger 251 is disposed in parallel with the burner 220. Since the hot water heat exchanger 251 is used intermittently whenever a user needs it, it is disposed in parallel with the burner 220 for energy efficiency. The hot water heat exchanger 25 is connected to a hot water supply pipe 252, and the hot water supply pipe 252 is connected to the third refrigerant pipe 210 so as to be in parallel with the burner 220.

The boiler 220 includes a hot water switching valve 253. The hot water switching valve 253 connects the third refrigerant pipe 210 and the hot water supply pipe 252. The hot water switching valve 253 may be a three-way valve. When the hot water switching valve 253 is operated, the second refrigerant selectively flows through the hot water heat exchanger 251.

The boiler 200 includes a shutoff valve 260. The shutoff valve is a component which is disposed in the third refrigerant pipe 210 and blocks the third refrigerant pipe 210. The boiler shutoff valve 260 is disposed in the third refrigerant pipe 210 of the inlet end side of the boiler 200. The boiler shut-off valve 260 is disposed in the inlet side of the third refrigerant pipe 210 to open and close the third refrigerant pipe 210, and an indoor heat exchanger switching valve 410 is disposed in the outlet side of the third refrigerant pipe 210 to open and close the third refrigerant pipe 210.

The boiler 200 may include a water supply port (not shown). The second refrigerant may be supplied through the water supply port.

The controller 500 is a component that controls the heat pump. The controller 500 may include a processor, and process acquired data. The controller 500 may include a storage unit, and store algorithms or setting values required for data processing.

The controller 500 may receive the pressure value of the first refrigerant from the pressure sensor 170. The controller 500 may receive a temperature value of the indoor heat exchanger 400 from a temperature sensor disposed in an inlet end of the indoor heat exchanger 400.

The controller 500 may determine the flow rate of the second refrigerant, based on the acquired data. When determining that the flow rate of the second refrigerant is insufficient, the controller 500 may supply the second refrigerant.

Hereinafter, a method of determining the flow rate of the second refrigerant by using a pressure value of the first refrigerant will be described.

Figure 3:
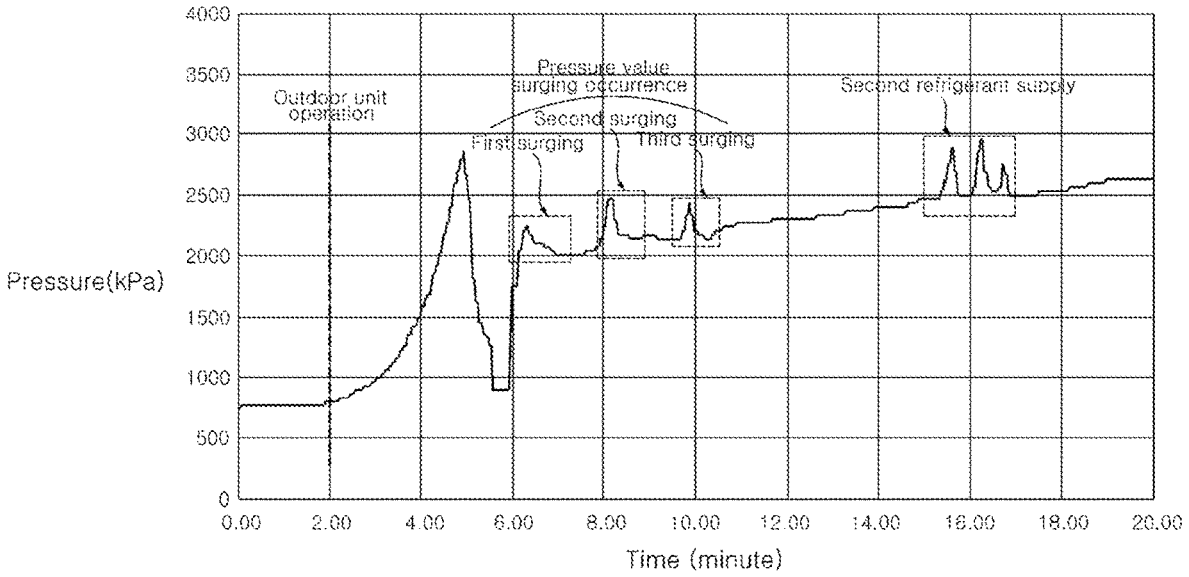
FIG. 3 is a diagram showing a pressure value of a first refrigerant over time measured by a pressure sensor according to the present disclosure.
Figure 4:
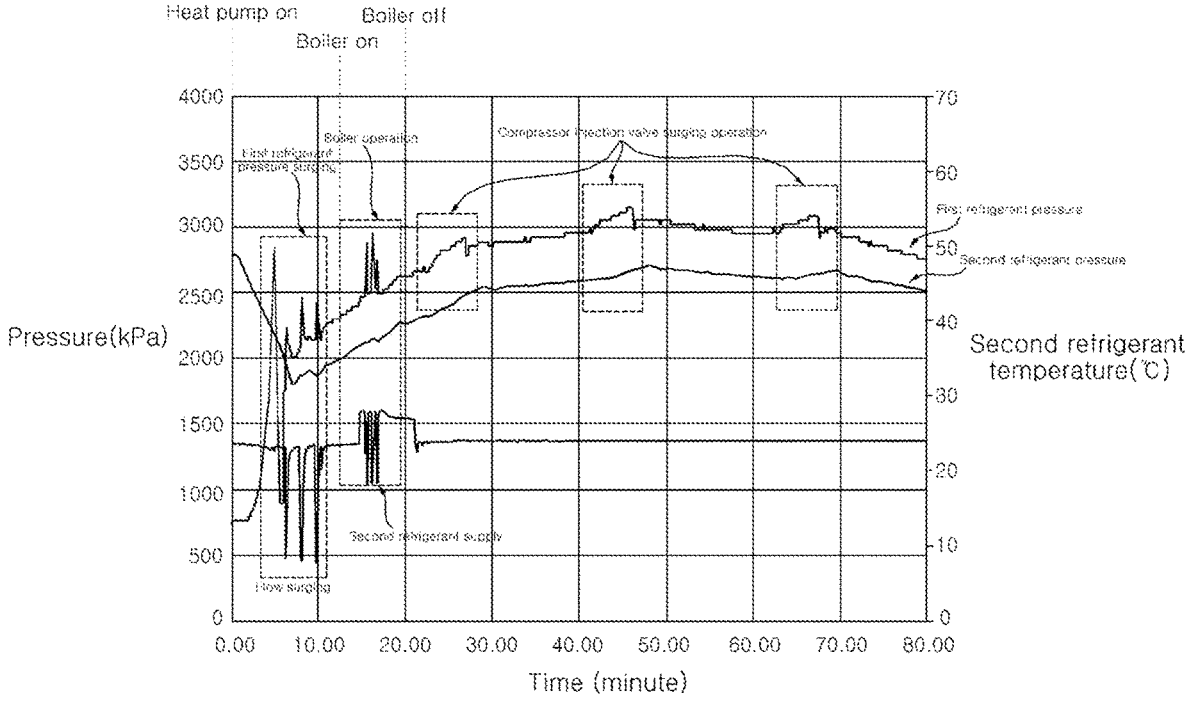
FIG. 4 is a diagram showing a pressure value of a first refrigerant, a temperature value of a second refrigerant, and a flow rate of the second refrigerant over time.

FIG. 3 is a diagram showing a pressure value of the first refrigerant according to time measured by the pressure sensor 170. FIG. 4 is a diagram showing a pressure value of the first refrigerant, the temperature value of the second refrigerant, and the flow rate of the second refrigerant over time.

When the outdoor unit 100 operates and the compressor 120 operates, the pressure of the first refrigerant of the outlet end of the compressor 120 gradually increases. However, surging may occur in the pressure value of the first refrigerant. Referring to FIG. 3, surging occurred about three times after the outdoor unit 100 is operated. Surging means that a rapid change occurs in a single waveform in a short time and then the waveform is maintained in a steady state.

The causes of surging are as follows. When a part of the second refrigerant evaporates or leaks, bubbles are generated. Accordingly, an irregular flow may occur between the first refrigerant and the second refrigerant or a heat exchange rate may decrease, and as a result, a sudden and temporary change in pressure of the first refrigerant may occur. In addition, a cavitation may occur in the pump due to the generation of bubbles, and surging may also occur due to the cavitation.

The controller 500 receives the pressure value of the first refrigerant from the pressure sensor 170. The controller 500 may receive the pressure value of the first refrigerant discharged from the compressor 120 and determine the surging of the pressure of the first refrigerant.

Referring to FIG. 3, surging occurs three times after the compressor 120 is operated 5 minutes after the start of measurement.

A first surging occurred at about 6 minutes. The peak value of the pressure of the first refrigerant is increased by 196 kPa from an average 2000 kPa, and the first surge is detected for about 49 seconds. The peak value of the temperature of the second refrigerant discharged from the second outdoor heat exchanger 160 is increased by about 2.7 degrees from the average.

A second surging occurred at about 8 minutes. The peak value of the pressure of the first refrigerant is increased by 294 kPa from an average 2200 kPa, and the second surging is detected for about 41 seconds. The peak value of the temperature of the second refrigerant discharged from the second outdoor heat exchanger 160 is increased by about 5 degrees from the average.

A third surging occurred at about 10 minutes. The peak value of the pressure of the first refrigerant is increased by 196 kPa from an average 2200 kPa, and the first surging is detected for about 40 seconds. The peak value of the temperature of the second refrigerant discharged from the second outdoor heat exchanger 160 is increased by about 2.3 degrees from the average.

The controller 500 determines that surging has occurred when the pressure value of the first refrigerant measured by the pressure sensor 170 exceeds the average by 10%. For example, the controller 500 may determine that surging has occurred when the pressure of the first refrigerant has a pressure value exceeding the average by 190 kPa. The reference pressure value is not limited to 10% or 190 kPa, and other reference may be applied in consideration of the surrounding environment in which the heat pump is installed within a range that can be easily adopted by a person skilled in the art.

A peak pressure value of the first refrigerant for determining surging may be determined according to experiments. According to experiments, the peak pressure value of the first refrigerant may be set to a value ranging from 100 kPa to 500 kPa in comparison with an average pressure.

The controller 500 determines that surging has occurred, when the duration for which the pressure value of the first refrigerant exceeds the average is 40 seconds or less. For example, the controller 500 may determine that surging has occurred in the first refrigerant, when the pressure of the first refrigerant is increased irregularly within 40 seconds based on the average as a reference, and if, in this case, a peak value exceeds the average by 190 kPa. The duration as a reference is not limited to 40 seconds, and other reference may be applied in consideration of the surrounding environment in which the heat pump is installed within a range that can be easily adopted by a person skilled in the art.

The controller 500 determines that the second refrigerant is insufficient, when surging is repeated a preset number of times or more during a preset time Tref, after an initial surging occurs.

The preset time Tref may be set to 20 minutes. The preset number of times Nref may be set to 5 times.

When the outdoor unit 100 is operated, the pressure value of the first refrigerant may fluctuate irregularly for any reason. Therefore, the controller 500 determines that the second refrigerant is insufficient, when surging of the first refrigerant occurs a preset number of times Nref or more, during the preset time Tref after the initial surging occurs. On the other hand, when surging of the first refrigerant occurs less than the preset number of times Nref during the preset time Tref after the initial surging occurs, it is determined that the problem is temporary and normal operation continues.

The controller 500 may determine the flow rate of the second refrigerant flowing through the second refrigerant pipe 310, based on the pressure value measured by the pressure sensor 170 disposed in the first refrigerant pipe 110. More specifically, when surging occurs in the pressure value of the first refrigerant flowing through the first refrigerant pipe 110, the controller 500 detects this, and determines that the flow rate of the second refrigerant is insufficient. There is an effect that the flow rate of the second refrigerant can be checked without disposing a separate flow sensor in the second refrigerant pipe 310.

The preset time Tref may be determined according to experiment. According to experiment, the preset time Tref can be determined within a value of 10 minutes to 50 minutes.

The number of occurrences N of surging for determining whether the second refrigerant is insufficient may be determined according to experiment. According to experiment, the preset number of times Nref may be determined within a value of 2 times to 20 times.

FIG. 4 shows the flow rate of the second refrigerant, the pressure of the first refrigerant, and the temperature of the second refrigerant according to time.

Referring to FIG. 4, the second refrigerant becomes insufficient from about 6 minutes to about 10 minutes, and surging occurs in the flow rate of the second refrigerant. In response to the surging of the second refrigerant, surging also occurs in the pressure of the first refrigerant. However, the change amount in the temperature of the second refrigerant is insignificant. In particular, the temperature sensor disposed in the indoor heat exchanger 400 shows only a variation range of about 0.3 degrees. Accordingly, in the heat pump according to the present disclosure, the controller 500 may determine the shortage of the second refrigerant by measuring the pressure value of the first refrigerant instead of the temperature of the second refrigerant.

Figure 2:
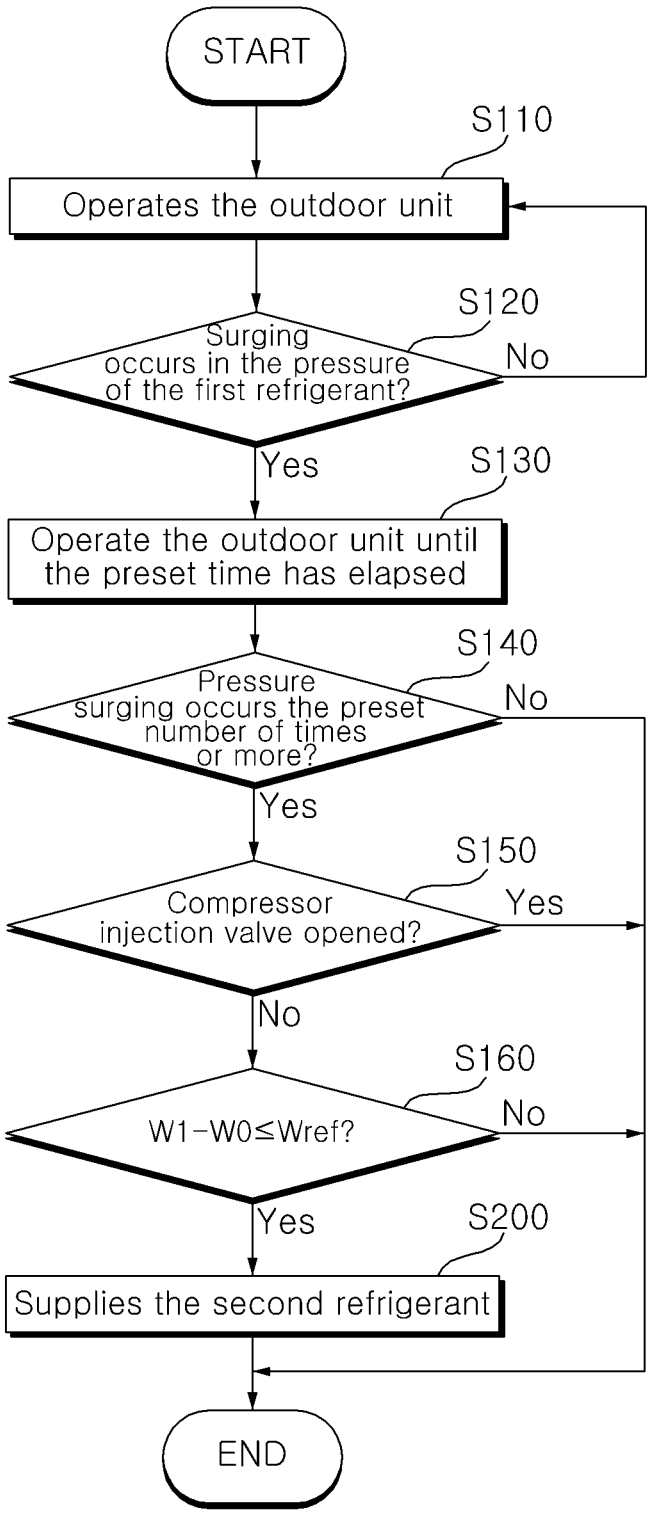
FIG. 2 is a flow chart showing a control method of a heat pump according to the present disclosure.

Referring to FIG. 2, a method of controlling a heat pump according to the present disclosure will be described.

The controller 500 operates the outdoor unit 100 (S110). The controller 500 receives a pressure value from the pressure sensor 170 disposed in the first refrigerant pipe 110, and determines the pressure surging of the first refrigerant to determine the flow rate of the second refrigerant (S120 to S160). When determining that the second refrigerant is insufficient, the controller 500 supplies the second refrigerant (S200). Hereinafter, each step will be described in detail.

The controller 500 operates the outdoor unit 100 (S110).

In the case of heating operation, in the second outdoor heat exchanger 160 of the outdoor unit 100, the heat of the first refrigerant is transferred to the second refrigerant. The second refrigerant discharged from the second outdoor heat exchanger 160 flows through the indoor heat exchanger 400, and transfers heat to indoor air. During the flow of the second refrigerant, evaporation due to heat may occur or the flow rate of the second refrigerant may decrease due to leakage.

Meanwhile, the pressure sensor 170 is disposed in the first refrigerant pipe 110. The pressure sensor 170 measures the pressure of the first refrigerant, and transmits a pressure value to the controller 500.

The controller 500 determines whether surging occurs in the pressure of the first refrigerant (S120).

For example, the controller 500 calculates the average of the pressure value of the first refrigerant, and may determine that the pressure of the first refrigerant is surging, when the pressure of the first refrigerant indicates an irregular pressure value within 40 seconds, and the peak of the pressure value is 190 kPa or more compared to the average value. When surging does not occur in the pressure of the first refrigerant, the controller 500 continues to operate the outdoor unit 100 (S110). When determining that the pressure value of the first refrigerant is surging, the controller 500 continues to operate the outdoor unit 100 until the preset time Tref has elapsed (S130). At this time, the preset time Tref may be about 20 minutes.

The controller 500 determines whether pressure surging occurs the preset number of times Nref or more (S140). For example, the controller 500 may determine that the second refrigerant is insufficient, when pressure surging occurs five or more times, during 20 minutes after an initial pressure surging occurs. The controller 500 terminates a step, when the pressure surging occurs less than the preset number of times Nref within the preset time Tref. When the step is terminated, the normal operation of the heat pump may be continued or the operation of the heat pump may be stopped. The controller 500 determines that the second refrigerant is insufficient, when the pressure surging occurs the preset number of times Nref or more within the preset time Tref.

When a compressor injection valve 182 is not opened, the controller 500 determines that the second refrigerant is insufficient (S150). The controller 500 supplies the second refrigerant when the compressor injection valve 182 is not open, and terminates the step when the compressor injection valve 182 is open.

Referring to FIG. 4, when the compressor injection valve 182 is opened and a part of the first refrigerant is bypassed to the compressor 120, the pressure of the first refrigerant may temporarily increase. Accordingly, the controller 500 may miscalculate that the injection of the first refrigerant into the compressor 120 indicates that the second refrigerant is insufficient. Therefore, the controller 500 does not determine that the second refrigerant is insufficient if the compressor injection valve 182 is open, even when the pressure surging occurs the preset number of times Nref or more at step S140.

The controller 500 determines that the second refrigerant is insufficient, when a difference between the current number of revolutions w1 of the compressor 120 and the number of revolutions w0 at the time of initial surging is equal to or less than preset number of revolutions Wref (S160). The controller 500 terminates a step, if a difference between the current number of revolutions w1 of the compressor and the number of revolutions w0 at the time of the initial surging exceeds the set number of revolutions Wref, because the current number of revolutions w1 of the compressor 120 is higher than the number of revolutions w0 at the time of the initial surging.

For example, if the number of revolutions w of the compressor is increased rapidly, and the difference between the current number of revolutions w1 and the number of revolutions w0 at the time of the initial surging is changed by more than 10 Hz, the controller 500 may miscalculate that the increase in the number of revolutions w of the compressor indicates the insufficiency of the second refrigerant. Therefore, when the number of revolutions w1 of the compressor is increased by the preset number of revolutions Wref or more than the number of revolutions w0 at the time of initial surging, it is not determined that the second refrigerant is insufficient.

The controller 500 supplies the second refrigerant (S200).

When determining that the flow rate of the second refrigerant is insufficient, the controller 500 supplies the second refrigerant through the second refrigerant pipe port 330 disposed in the second refrigerant pipe 310. A water supply tank may be disposed in the second refrigerant pipe port 330, and the controller 500 supplies water from the water supply tank, when it is determined that the flow rate of the second refrigerant is insufficient.

When determining that the flow rate of the second refrigerant is insufficient, the controller 500 operates the boiler 200 to supply the second refrigerant to the indoor heat exchanger 400.

The boiler 200 circulates the second refrigerant and supplies heat to the indoor heat exchanger 400. The boiler 200 independently includes a component that additionally supplies the second refrigerant, and when the controller 500 operates the boiler 200, the second refrigerant is additionally supplied by the boiler 200. The boiler 200 includes an expansion tank 230. When the second refrigerant is insufficient, the expansion tank 230 introduces the second refrigerant into the third refrigerant pipe 210, and the introduced second refrigerant may flow into the second refrigerant pipe 310 after passing through the indoor heat exchanger 400. The controller 500 receives the second refrigerant from the boiler 200 by operating the boiler shut-off valve 260 and the indoor heat exchanger switching valve 410. Alternatively, the second refrigerant may be supplied from the boiler 200 by operating only the indoor heat exchanger switching valve 410.

The operation of the heat pump according to the present disclosure configured as described above and the control method thereof will be described below.

The controller 500 determines the flow rate of the second refrigerant flowing through the second refrigerant pipe 310. When it is determined that the second refrigerant is insufficient, the controller 500 maintains a cooling and heating performance by supplying the second refrigerant. Without separately disposing a sensor in the second refrigerant pipe 310, the controller 500 can determine the flow rate of the second refrigerant by using the pressure value of the first refrigerant. The controller 500 may determine the surging of the pressure value of the first refrigerant, and based on this, determine the shortage of the second refrigerant. Therefore, there is an effect that the heat pump can be controlled without the need to additionally install a separate sensor.

In order to control the indoor temperature, a temperature sensor is disposed in the second refrigerant pipe 310 adjacent to the indoor heat exchanger 400. However, there is a problem in that the temperature sensor cannot accurately determine the water shortage in the second refrigerant pipe 310. However, in the heat pump according to the present disclosure, the controller 500 has an effect of accurately determining the water shortage in the second refrigerant pipe 310 by using the pressure value of the first refrigerant.

Although the present disclosure has been described with reference to specific embodiments shown in the drawings, it is apparent to those skilled in the art that the present description is not limited to those exemplary embodiments and is embodied in many forms without departing from the scope of the present disclosure, which is described in the following claims. These modifications should not be individually understood from the technical spirit or scope of the present disclosure.

The invention claimed is:

1. A heat pump, comprising:

an outdoor unit comprising a compressor that compresses a first refrigerant, a first outdoor heat exchanger that exchanges heat between the first refrigerant and outdoor air, an expansion mechanism that expands the first refrigerant, and a second outdoor heat exchanger that exchanges heat between the first refrigerant and a second refrigerant;

a first refrigerant pipe that connects the compressor, the first outdoor heat exchanger, and the expansion mechanism, and through which the first refrigerant flows;

a pressure sensor disposed in the first refrigerant pipe;

a second refrigerant pipe that is connected to the second outdoor heat exchanger, and through which the second refrigerant flows;

an indoor heat exchanger that is disposed in the second refrigerant pipe, and exchanges heat between indoor air and the second refrigerant;

a controller configured to determine a supply of the second refrigerant by determining a flow rate of the second refrigerant based on surging occurring in a pressure of the first refrigerant measured by the pressure sensor; and a second refrigerant pipe port disposed in the second refrigerant pipe, wherein the controller supplies the second refrigerant through the second refrigerant pipe port, when it is determined that a flow rate of the second refrigerant is insufficient.

2. The heat pump of claim 1, wherein the pressure sensor is disposed in the first refrigerant pipe adjacent to a discharge port of the compressor.

3. The heat pump of claim 1, wherein the controller supplies the second refrigerant, when surging is repeated a preset number of times or more for a preset time, after an initial surging occurs.

4. The heat pump of claim 1, further comprising a compressor injection pipe connected to the compressor and a compressor injection valve disposed in the compressor injection pipe, wherein the controller supplies the second refrigerant when the compressor injection valve is not opened.

5. The heat pump of claim 1, wherein the controller supplies the second refrigerant, when a difference between a current number of revolutions of the compressor and a number of revolutions at the time of initial surging is equal to or less than a preset number of revolutions.

6. The heat pump of claim 1, further comprising:

a boiler which is disposed in parallel with the outdoor unit, and heats a second refrigerant; and a third refrigerant pipe which connects the boiler and the indoor heat exchanger, and through which the second refrigerant flows, wherein the controller operates the boiler and supplies the second refrigerant to the indoor heat exchanger, when it is determined that the flow rate of the second refrigerant is insufficient.

7. The heat pump of claim 6, further comprising:

an indoor heat exchanger switching valve which is connected to the indoor heat exchanger or at least one of the second refrigerant pipe or the third refrigerant pipe, and switches a refrigerant flow between the indoor heat exchanger and the second refrigerant.

8. The heat pump of claim 6, wherein the boiler comprises:

an expansion tank disposed in the third refrigerant pipe; and a boiler pump which is disposed in the third refrigerant pipe, and pumps the third refrigerant.

9. The heat pump of claim 1, further comprising an indoor unit through which the second refrigerant pipe passes, and which comprises an indoor unit pump that is disposed in the second refrigerant pipe and pumps the second refrigerant.

10. A heat pump, comprising:

an outdoor unit comprising a compressor for that compresses a first refrigerant, a first outdoor heat exchanger that exchanges heat between the first refrigerant and outdoor air, an expansion mechanism that expands the first refrigerant, and a second outdoor heat exchanger that exchanges heat between the first refrigerant and a second refrigerant;

a first refrigerant pipe that connects the compressor, the first outdoor heat exchanger, and the expansion mechanism, and through which the first refrigerant flows;

a pressure sensor disposed in the first refrigerant pipe;

a second refrigerant pipe that is connected to the second outdoor heat exchanger, and through which the second refrigerant flows;

an indoor heat exchanger that is disposed in the second refrigerant pipe, and exchanges heat between indoor air and the second refrigerant;

a controller configured to determine a supply of the second refrigerant by determining a flow rate of the second refrigerant based on surging occurring in a pressure of the first refrigerant measured by the pressure sensor; and a compressor injection pipe connected to the compressor and a compressor injection valve disposed in the compressor injection pipe, wherein the controller supplies the second refrigerant when the compressor injection valve is not opened.

11. The heat pump of claim 10, wherein the pressure sensor is disposed in the first refrigerant pipe adjacent to a discharge port of the compressor.

12. The heat pump of claim 10, further comprising an indoor unit through which the second refrigerant pipe passes, and which comprises an indoor unit pump that is disposed in the second refrigerant pipe and pumps the second refrigerant.

13. A heat pump, comprising:

an outdoor unit comprising a compressor for that compresses a first refrigerant, a first outdoor heat exchanger that exchanges heat between the first refrigerant and outdoor air, an expansion mechanism that expands the first refrigerant, and a second outdoor heat exchanger that exchanges heat between the first refrigerant and a second refrigerant;

a first refrigerant pipe that connects the compressor, the first outdoor heat exchanger, and the expansion mechanism, and through which the first refrigerant flows;

a pressure sensor disposed in the first refrigerant pipe;

a second refrigerant pipe that is connected to the second outdoor heat exchanger, and through which the second refrigerant flows;

an indoor heat exchanger that is disposed in the second refrigerant pipe, and exchanges heat between indoor air and the second refrigerant;

a controller configured to determine a supply of the second refrigerant by determining a flow rate of the second refrigerant based on surging occurring in a pressure of the first refrigerant measured by the pressure sensor;

a boiler which is disposed in parallel with the outdoor unit, and heats a second refrigerant; and a third refrigerant pipe which connects the boiler and the indoor heat exchanger, and through which the second refrigerant flows, wherein the controller operates the boiler and supplies the second refrigerant to the indoor heat exchanger, when it is determined that the flow rate of the second refrigerant is insufficient.

14. The heat pump of claim 13, further comprising:

an indoor heat exchanger switching valve which is connected to the indoor heat exchanger or at least one of the second refrigerant pipe or the third refrigerant pipe, and switches a refrigerant flow between the indoor heat exchanger and the second refrigerant pipe and the third refrigerant pipe, wherein the controller opens the indoor heat exchanger switching valve so that the indoor heat exchanger and the third refrigerant pipe communicate with each other, when it is determined that the flow rate of the second refrigerant is insufficient.

15. The heat pump of claim 13, wherein the boiler comprises:

an expansion tank disposed in the third refrigerant pipe; and a boiler pump which is disposed in the third refrigerant pipe, and pumps the third refrigerant.

16. The heat pump of claim 13, wherein the pressure sensor is disposed in the first refrigerant pipe adjacent to a discharge port of the compressor.

17. The heat pump of claim 13, further comprising an indoor unit through which the second refrigerant pipe passes, and which comprises an indoor unit pump that is disposed in the second refrigerant pipe and pumps the second refrigerant.

* * * * *